US005809752A

United States Patent [19]

Holbrook

[11] Patent Number: 5,809,752

[45] Date of Patent: Sep. 22, 1998

[54] SEALING DEVICE FOR A MAILING MACHINE

[75] Inventor: Russell W. Holbrook, Southbury, Conn.

[73] Assignee: Pitney Bowes Inc., Stamford, Conn.

[21] Appl. No.: 773,851

[22] Filed: Dec. 27, 1996

[51] Int. Cl.[6] ..... B42D 15/00

[52] U.S. Cl. ..... 53/569; 53/284.3; 53/377.4; 53/377.6

[58] Field of Search ..... 53/569, 377.4, 53/377.6, 460, 476, 284.3, 206; 156/441.5, 442, 442.1, 442.2; 493/260, 261

[56] References Cited

U.S. PATENT DOCUMENTS

| | | | |
|---|---|---|---|
| 1,035,294 | 8/1912 | Young | 156/441.5 |
| 2,015,507 | 9/1935 | Arnold | 156/442.1 |
| 2,609,790 | 9/1952 | Uhl | 118/401 |
| 3,878,025 | 4/1975 | Storace et al. | 156/441.5 |
| 4,004,962 | 1/1977 | Kleid | 156/475 |
| 4,499,705 | 2/1985 | Russell | 53/284.3 |
| 4,609,421 | 9/1986 | Yui | 156/442.1 |
| 4,742,878 | 5/1988 | Freeman et al. | 177/25 |
| 4,773,962 | 9/1988 | Garrigue | 156/441.5 |
| 4,932,188 | 6/1990 | Krasuski et al. | 53/64 |
| 4,955,483 | 9/1990 | O'Dea et al. | 209/548 |
| 4,956,782 | 9/1990 | Freeman et al. | 364/464.03 |
| 5,098,734 | 3/1992 | O'Dea et al. | 427/8 |
| 5,180,151 | 1/1993 | Branecky et al. | 270/45 |
| 5,209,806 | 5/1993 | Hibberd | 156/441.5 |
| 5,217,551 | 6/1993 | Nobile et al. | 156/64 |
| 5,238,123 | 8/1993 | Tovini et al. | 209/556 |
| 5,518,574 | 5/1996 | Yates | 156/442.1 |
| 5,555,701 | 9/1996 | Fehringer | 53/75 |
| 5,665,198 | 9/1997 | Bieber | 156/441.5 |

FOREIGN PATENT DOCUMENTS

| | | | |
|---|---|---|---|
| 1171847 | 7/1989 | Japan | 156/441.5 |

*Primary Examiner*—John Sipos
*Assistant Examiner*—James P. Calve
*Attorney, Agent, or Firm*—Steven J. Shapiro; Melvin J. Scolnick

[57] ABSTRACT

A sealing device, for use in a mailing machine having a moistener for applying moistening fluid to flaps of envelopes being transported through the mailing machine, includes a first device, having a first surface, for applying pressure to a moistened envelope flap via the first surface; and a second device, having a second surface opposite the first surface, for applying pressure to the moistened envelope flap via the second surface. The first and second surfaces operatively cooperate together to apply pressure to and seal the moistened envelope flap. Furthermore, in the inventive device, moistening fluid is transferred on to the first surface from the moistened flap during sealing of the moistened flap by the first and second surfaces, and the first and second surfaces are aligned relative to each other such that at times when the moistened envelope is transported away from the sealing device moistening fluid is not transferred from the first surface to the second surface.

5 Claims, 2 Drawing Sheets

SEALING DEVICE FOR A MAILING MACHINE

BACKGROUND

This invention relates to a sealing device in a mailing machine and more particularly relates to a sealing device for use in a mailing machine which incorporates digital printing techniques.

Mailing machines which process pieces of mail (such as envelopes) through a plurality of processing stations are well known and embodied, for example, in U.S. Pat. No. 5,098,734 which issued to O'Dea, et al. on Mar. 24, 1992. These mailing machines typically singulate and transport individual envelopes through an envelope flap moistener, a flap sealing device, and a postage meter where printing of postage on the envelope occurs. Most postage meters utilize a rotary drum with a die thereon or a flatbed type of die for printing the postage on the envelope. The inks used in these postage meters are oil based inks which are very stable in water. Therefore, if the surface of the envelope being printed on becomes wet due to excess moistening fluid which has been deposited thereon by the sealing device, the printed postage will still be satisfactorily printed onto the envelope.

Currently, because of environmental concerns, the use of water based inks in postage meters is highly desirable. Moreover, because of the flexibility in printing provide by digital printing devices, there is a trend to incorporate digital printers utilizing ink jet printing technology in postage meters for the purpose of printing the postal indicia and an optional advertising slogan on the envelope. One of the more common ink jet printers incorporates bubble jet printing technology which requires the utilization of a water based ink in order to operate. However, since the very nature of a water based ink is that it is soluble in water, a problem exists in that if any water is present on the print surface of the envelope, the image which is printed by a bubble jet printer on the moistened envelope will be smeared and of a degraded quality because the water based ink will react and begin to dissolve in the water present on the envelope print surface.

Thus, what is needed is a sealing device which can be utilized in a system where water based inks are used to form an image.

SUMMARY OF THE INVENTION

It is an object of the invention to provide a sealing device which seals the flap of an envelope without transferring any excess moistening fluid, utilized in the sealing process, onto the print surface of the envelope.

The above object is met by a sealing device for use in a mailing machine having a moistener for applying moistening fluid to flaps of envelopes being transported through the mailing machine, the sealing device including a first device, having a first surface, for applying pressure to a moistened envelope flap via the first surface; and a second device, having a second surface opposite the first surface, for applying pressure to the moistened envelope flap via the second surface. The first and second surfaces operatively cooperate together to apply pressure to and seal the moistened envelope flap. Furthermore, in the inventive device, moistening fluid is transferred on to the first surface from the moistened flap during sealing of the moistened flap by the first and second surfaces, and the first and second surfaces are aligned relative to each other such that at times when the moistened envelope is transported away from the sealing device moistening fluid is not transferred from the first surface to the second surface.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
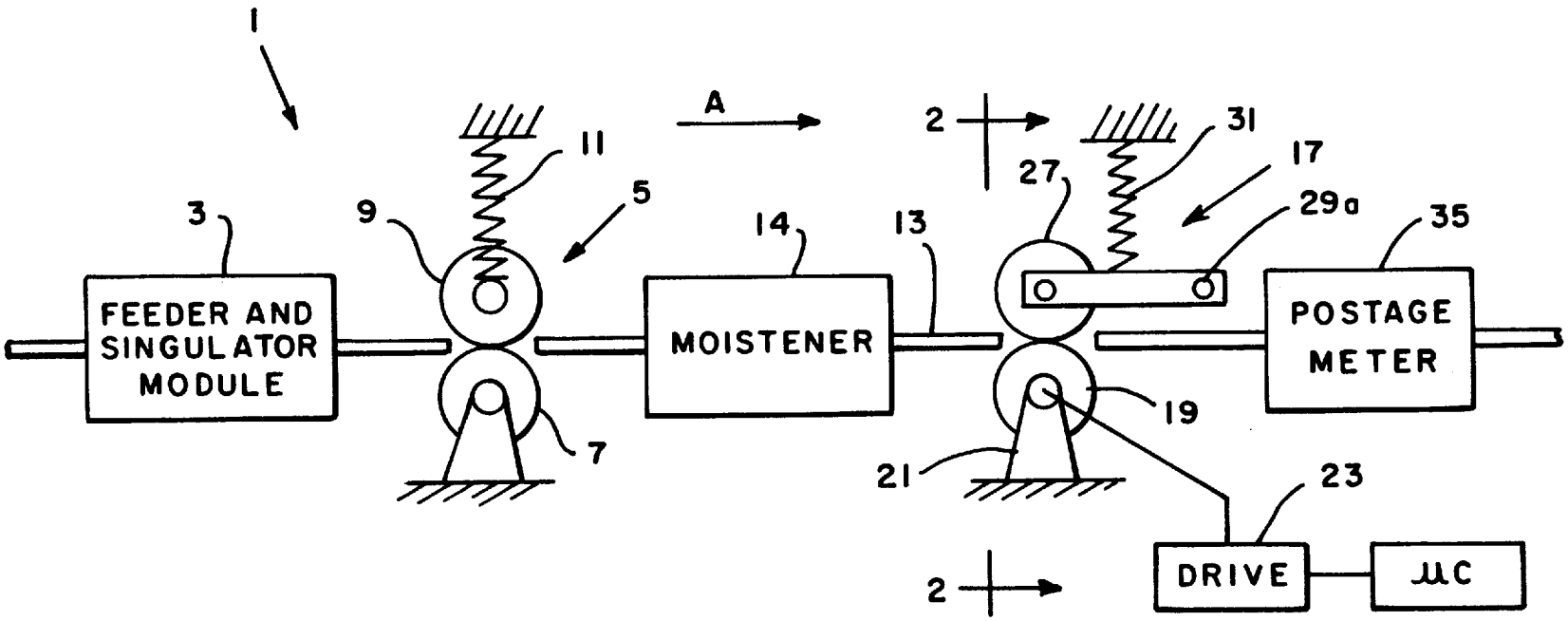
FIG. 1 (PRIOR ART)
FIG. 1 is a schematic side view of a conventional mailing machine.
Figure 2:
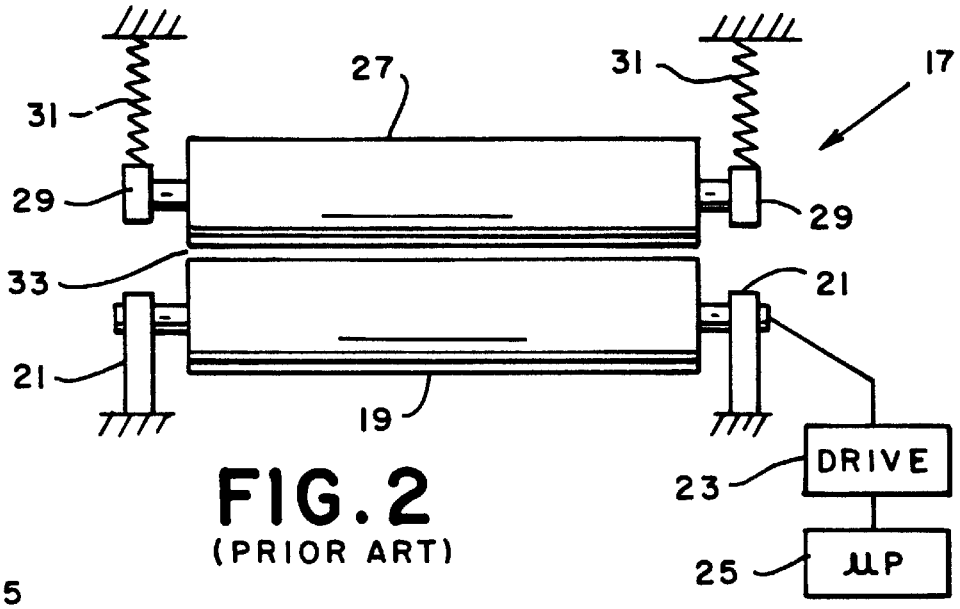
FIG. 2 (PRIOR ART)
FIG. 2 is a sectional view of the mailing machine of FIG. 1 taken along line II—II.

FIGS. 1 and 2 show in schematic form a conventional mailing machine 1. Mailing machine 1 includes a feeder and singulator module 3 which receives a stack of mail pieces (i.e. envelopes) and singulates the individual envelopes for processing through mailing machine 1. A conventional conveyor system 5 includes a driven roller 7 and a backup roller 9 which is spring loaded into contact with driven roller 7 by a biasing spring 11. The conveyor system 5 is used to transport the individual mailpieces through the mailing machine 1 along deck 13. In order to simplify the illustration, only one pair of drive and backup rollers 7, 9 is shown. However, one possessing ordinary skill in the art will understand that a plurality of rollers 7, 9 are dispersed throughout the mailing machine 1 along deck 13 in order to transport the envelope through each station in mailing machine 1.

Figure 3:
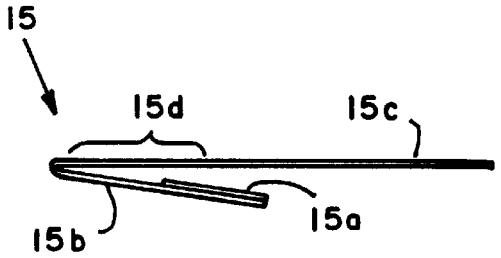
FIG. 3 (PRIOR ART)
FIG. 3 shows a conventional envelope.

Mailing machine 1 further includes a conventional moistener 14 which is used to moisten a gummed portion 15*a* of flap 15*b* of an envelope 15 (see FIG. 3) being processed through mailing machine 1. Moistener 14 can, for example, be any type of conventional device including those that moisten via a wick, a belt, a spray nozzle, or a brush. FIG. 3 shows envelope 15 in the orientation that it is in while passing through the mailing machine 1 along deck 13 in the direction of arrow "A" of FIG. 1. Upon leaving the moistener 14, envelope 15 is processed through a sealing device 17 which applies pressure to envelope 15 so that the moistened and activated gummed portion 15*a* of flap 15*b* seals against the underside of a main body portion 15*c* of envelope 15. Sealing device 17 includes a driven roller 19 which is mounted for rotation in supports 21. Supports 21 are fixedly mounted within a main housing structure (not shown) of mailing machine 1. Driven roller 19 is driven into rotation by a drive system 23 which includes a motor (not shown) having a direct drive connection to driven roller 19 or a belt and pulley system connection to driven roller 19. Operation of the drive system 23 is controlled by a microcontroller 25 of mailing machine 1. Sealing device 17 further includes a backup roller 27 which is mounted for rotation in a pair of pivoting arms 29. Arms 29 rotate about a pivot point 29*a* within mailing machine 1. Each arm 29 is biased downwardly by a respective spring 31 so that backup roller 27 is brought into contact with driven roller 19 to form a nip 33 therebetween. Thus, as envelope 15 passes into nip 33, backup roller 27 moves upwardly to accommodate envelope 15. As driven roller 19 is forced into rotation, envelope 15 passes between driven roller 19 and backup roller 27 such that a force is applied by each of the rollers 19, 27 to envelope 15 whereupon flap 15*b* is pressed against the underside of main body 15*c* so that envelope flap 15*b* is sealed by the moistened gummed portion 15*a* against main body 15*c*. Subsequent to the sealing process, envelope 15 is transported to a postage meter 35 whereupon a postage indicia image together with an optional advertising slogan is printed on print zone 15*d* on the top surface of main body 15*c*.

In the mailing machine of FIG. 1, as envelope 15 is sealed by sealing device 17, excess moistening fluid applied by moistener 14 is forced out from beneath flap 15*b* during the sealing action and is transferred to the outer surface of driven roller 19. Subsequently, when the sealed envelope 15 leaves the sealing device 17, driven roller 19 and backup roller 27 come into contact with each other such that some of the excess moistening fluid which is present on driven roller 19 is transferred to backup roller 27. Accordingly, when the next envelope 15 is processed through sealing device 17, printing zone 15*d* of the next envelope 15 will have moistening fluid transferred thereto from roller 27. As previously discussed, in systems using oil based inks the indicia image and advertising slogan could still be satisfactorily applied to the envelope 15 despite the presence of the moistening fluid on the envelope. However, in the situation where postage meter 35 utilizes a digital printing device incorporating a water based ink, an image of unacceptable quality is produced due to the presence of moistening fluid in the print zone 15*d*.

Figure 4:
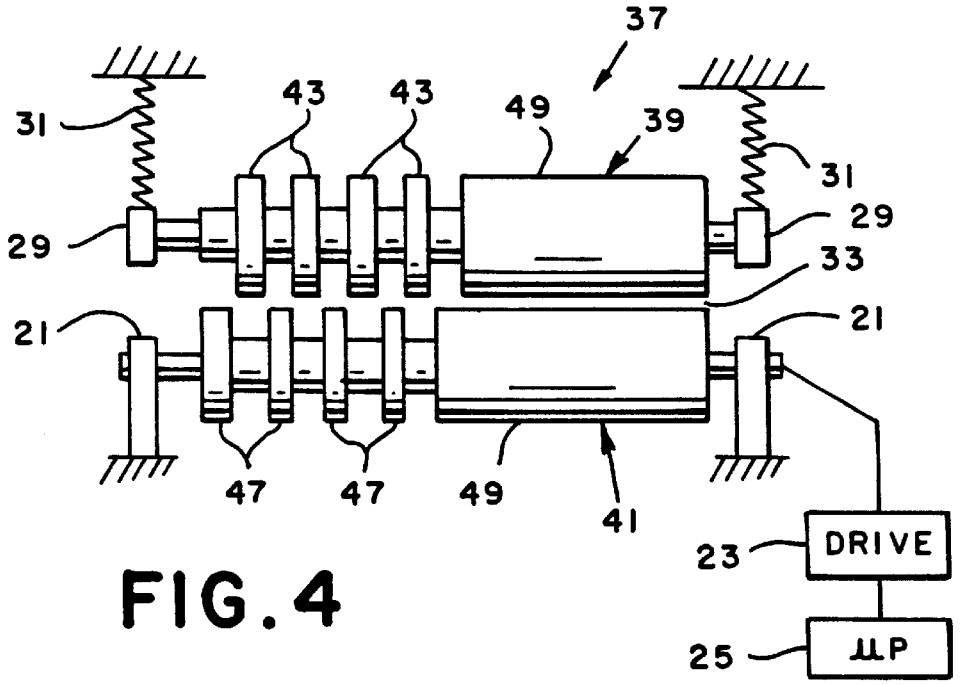
FIG. 4 shows the inventive sealing device.

FIG. 4 shows the inventive sealing device 37 which is implemented in mailing machine 1 as a replacement for sealing device 17 in order to overcome the problems discussed above in connection with the prior art sealing devices. In FIG. 4, like numerals are used for the components of sealing device 37 which are identical in structure and function to the similarly numbered components of sealing device 17. Therefore, a repeat description of these identical components has been omitted for ease of explanation of the invention. Sealing device 37 includes an idler roller 39 and a driven roller 41. Idler roller 39 has identical roller segments 43 and a larger roller segment 45, while driven roller 41 has identical roller segments 47 and a larger roller segment 49. For each roller 39, 41 only the respective segments 43/45 and 47/49 contact the envelope 15 as it enters into nip 33. The segments 43 and 47 are each positioned in the area of the print zone 15*d* and are laterally offset from each other so that they will not contact each other when envelope 15 is conveyed out of sealing device 37. Thus, even if excess moistening fluid is transferred from envelope 15 onto segments 47 of driven roller 41, this excess moistening fluid will not in turn be transferred to idler roller 39 subsequent to the envelope being conveyed out of sealing device 37. It is important to note however, that the segments 43, 45, 47, and 49 still apply the requisite pressure to ensure sealing of envelope flap 15*b*.

While the above-described sealing device 37 shows the use of a plurality of identical segments and a larger segment on each roller 39, 41, variations can be substituted therefor. For example each roller 39, 41 could consist entirely of a plurality of identical segments with the segments on each roller being offset from the segments of the other roller. Moreover, a combination of different sized segments could be used. One skilled in the art will recognize the size and spacing of the segments can be varied as long as the transfer of fluid from the bottom roller to the top roller is prevented, the requisite sealing pressure is applied, and the envelope is not damaged by the orientation of the segments.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims.

What is claimed is:

1. In a mailing machine which transports an envelope having a flap with a summed portion and a main body portion, a sealing device comprising:

a means for applying a moistening fluid to the gummed portion;

a first roller downstream of said moistening means having a first plurality of segmented roller surfaces; and a second roller having a second plurality of segmented roller surfaces opposite to and laterally and axially offset without mutual contact from the first plurality of segmented roller surfaces, the first and second plurality of segmented roller surfaces operatively cooperating together to apply pressure to the envelope flap to seal the envelope flap to the main body portion at times when the gummed portion has been moistened by the applying means;

wherein at times when the first and second plurality of segmented roller surfaces apply pressure to the envelope flap at least some of the moistening fluid is transferred on to at least some of the first plurality of segmented roller surfaces from the moistened gummed portion, and the first and second plurality of segmented roller surfaces are laterally offset relative to each other such that at times when the sealed envelope is transported away from the sealing device the at least some of the moistening fluid is not transferred from the at least some of the first plurality of segmented roller surfaces to the second plurality of segmented roller surfaces.

2. A sealing device as recited in claim 1, wherein each of the first plurality of segmented roller surfaces are equal in size, each of the second plurality of segmented roller surfaces are equal in size, and the first plurality of segmented roller surfaces do not contact the second plurality of segmented roller surfaces.

3. A sealing device as recited in claim 2, wherein the first plurality of segmented roller surfaces are spaced from each other along an axis of rotation of the first roller to define first roller spaces between the first plurality of segmented roller surfaces the second plurality of segmented roller surfaces are spaced from each other along an axis of rotation of the second roller to define second roller spaces between the second plurality of segmented roller surfaces, and each of the first plurality of segmented roller surfaces are aligned opposite a corresponding one of the second roller spaces and each of the second plurality of segmented roller surfaces are aligned opposite a corresponding one of the first roller spaces.

4. A sealing device as recited in claim 3, wherein the axis of rotation of the first roller and the axis of rotation of the second roller are parallel to each other and a width, as measured along a direction of the axis of rotation of the first roller, of each of the first and second plurality of segmented roller surfaces and of each of the first and second roller spaces is approximately equal.

5. A sealing device as recited in claim 2, wherein each of the first and second plurality of segmented roller surfaces are disposed only to cover an area correlating to an area of the flap of the envelope being transported through the mailing machine.

* * * * *